United States Patent [19]

Bäckmann

[11] Patent Number: 4,649,842

[45] Date of Patent: Mar. 17, 1987

[54] METHOD FOR THE AUTOMATICAL SEWING OF QUILTING PATTERNS IN FABRIC WEBS, ESPECIALLY BED SACKINGS OR TICKS OF (WADDED) BED QUILTS

[75] Inventor: Reinhard Bäckmann, Heimbuchenthal, Fed. Rep. of Germany

[73] Assignee: Anton Cramer GmbH & Co., Greven, Fed. Rep. of Germany

[21] Appl. No.: 617,728

[22] Filed: Jun. 6, 1984

[30] Foreign Application Priority Data

Jun. 16, 1983 [DE] Fed. Rep. of Germany ..... 3321749

[51] Int. Cl.[4] ..... D05B 11/00

[52] U.S. Cl. ..... 112/266.1; 112/117; 112/121.12; 112/305

[58] Field of Search ..... 112/117, 118, 121.14, 112/266.1, 305, 320, DIG. 2, 121.12

[56] References Cited

U.S. PATENT DOCUMENTS 2,538,334 1/1951 Schwartz ..... 112/118 X
3,183,866 5/1965 Walbert et al. ..... 112/266.1 X
3,421,464 1/1969 Cash ..... 112/118
4,327,653 5/1982 Blessing ..... 112/121.4

FOREIGN PATENT DOCUMENTS 379897 8/1964 Switzerland ..... 112/121.14

*Primary Examiner*—Wm. Carter Reynolds
*Attorney, Agent, or Firm*—Felfe & Lynch

[57] ABSTRACT

A method of automatically producing seams in fabric webs, especially sackings or ticks of (wadded) bed quilts, by producing the seams during, and with the aid of, a freely programmably relative movement between the fabric web and at least one sewing machine head. The fabric web is drawn continuously or successively (in steps) and against a constant take-up force along a linear path, and the sewing head performs program-controlled motions in a processed web portion extending transversely of said path a system for carrying out this method, utilizes a machine table and an associated quilting-sewing machine having an arm and a machine head mounted to the latter. The arm (20) is guided by a pair of supports (6, 7) positioned perpendicular with each other and adapted to be moved in the longitudinal direction (X) and transverse direction (Y) by freely programmably controlled drive apparatus.

3 Claims, 4 Drawing Figures

METHOD FOR THE AUTOMATICAL SEWING OF QUILTING PATTERNS IN FABRIC WEBS, ESPECIALLY BED SACKINGS OR TICKS OF (WADDED) BED QUILTS

The present invention relates to a method of automatically producing seams in fabric webs, especially sackings or ticks of (wadded) bed quilts, by producing the seams during, and with the aid of, a freely programmably relative movement between the fabric web and at least one sewing machine head, and to a system for carrying out such method.

According to the prior art, bed sackings or ticks for (wadded) bed quilts were heretofore sewed predominantly by a manual method. In these sackings or ticks, one upper sheet and lower sheet each for a filling of down (feathers) or non-woven material are interconnected by quilting seams, mostly in a circular shape, but also in the form of lines (linearly). In the manual sewing process, a circular movement of the fabric below the needle is established by the sewing machine.

Drawbacks of this process are both low speed of operation and inadequate precision of the circular motion which is impeded by the sacking or tick which is difficult to move.

There have been proposed automatic quilting machines which in a freely programmable fashion track the overall surface area of a bed quilt and produce the quilt seams by means of a sewing head.

In this instance, the complete part to be sewed is fixedly stretched by a frame conformed to the dimensions of the part to be sewed. This frame, in turn, is positioned on a horizontal table plate having a longitudinal and a transverse support each so as to be movable universally, and further mechanically pivotable about a pivot point in the horizontal plane. A long arm mounts a stationary sewing head approximately in the center of the table. In the quilting process, the frame together with the part to be sewed is passed to and fro beneath the sewing head with freely programmed motion cycles by the mechanical driving system of the supports and the pivot means, whereby the quilting pattern is quilted.

Technical restraints and problems of this automatic quilting system reside in the fact that the movement can be performed only at a relatively low rate of speed, whereby the speed of operation is affected. Further, the manual stretching of the sacking or tick on the frame necessitates a substantial amount of working time. In view of the more than one hundred different sizes of ready-made articles that must be offered commercially and which result from the variations in length and width of the articles, a corresponding number of clamping (stretching) frames is required. Furthermore, the size of the sewing area is naturally limited by this principle of operation, and this moreover, results in extremely high cost of investment even for medium-size sackings or ticks.

The present invention is based upon the object to provide a method and a system for the automatical sewing of quilting patterns in fabric webs, which are suitable to avoid the above-discussed drawbacks and the technical restraints of the prior art. In particular, the speed of operation is to be increased substantially while at the same time providing for a maximum of precision of the quilting patterns; the use and handling of clamping frames should be omitted; and, further automatical sewing of quilting patterns should be rendered possible without problem even with sackings or ticks of the maximum customary dimensions, such as 280×280 cm. A system for carrying out this method should be uncomplicated in structure and adapted to be provided at low cost of investment as compared to conventional automatic quilting machines, considering its capacity. Still further, uncomplicated operation and a maximum of reliability are an important and self-evident aspect of this object.

According to the present invention, the above object is solved in a method of the kind as outlined above in that the fabric web is drawn continuously or successively (in steps) and against a constant take-up force along a linear path, and the sewing head performs program-controlled motions in a processed web portion extending transversely of said path.

As an advantage, the method according to the invention permits to obtain a quilting speed being substantially higher than that obtained with a stationary sewing head and moved or advanced material to be sewed. As the machine may be driven more exactly, the programmed quilting patterns are defined and held with a high degree of precision . Advantageously, stretching of the material to be sewed on a frame as well as the expensive stockage of more than one hundred of frames, requiring practical experience, become unnecessary.

In particular, the take-up force is produced by sucking the fabric web against vacuum bars on opposite sides of the processed web portion.

Substantial simplification of the automatic sewing process according to the invention, and therefore corresponding advantages, are achieved by an embodiment being essential to the invention, in that a sewing head quilts the processed web portion of the fabric web as defined by length and width, in one cycle of operation each in accordance with a program and in reciprocating fashion with the fabric web being held stationary, and that the fabric web is advanced in steps by one web portion (each) after every operating cycle.

Owing to the confinement of the machine control to a limited field of the fabric web in the automatic quilting process, the expenditure in machine and control or driving equipment is kept relatively low. This also provides for an optimum of control or driving quality and more exact definition of the quilting patterns.

An expedient embodiment resides in that a pair of sewing heads quilt the processed web portion, in a freely programmable fashion, each across a width corresponding to one-half of the width of the fabric web.

Advantageously, this results in an operation cycle sequence of repeatable or reproducible working steps with an optimum of performance and quality.

According to a further embodiment, the method may be performed in such a manner that the fabric web or the sacking (tick) is fixedly clamped at the front edge on the table by means of a longitudinally movably operable clamping beam, and longitudinally advanced by the latter across the table surface in accordance with a cycle sequence of the operation cycles.

The mode of operation provided in this way is advantageously characterized by uncomplicated, easily understandable and straight forward performance.

In this method, for providing a quilted product of maximum quality standards it is beneficial that the fabric web is advanced under longitudinal tension to the working area of the sewing head and maintained under tension during the sewing process.

An automatic quilting system for sewing quilting patterns in fabric webs, especially sackings or ticks of (wadded) bed quilts, by quilting during, and by means of, a freely programmable relative movement between the fabric web and a sewing machine head, especially for carrying out the method according to the invention, comprising a machine table and an associated quilting-sewing machine having an arm and a machine head mounted to the latter, is characterized in that the arm is guided by a pair of supports positioned perpendicular with each other and adapted to be moved in the longitudinal direction (X) and transverse direction (Y) by freely programmably controlled drive means.

The mechanical equipment according to the invention is therefore very compact and uncomplicated, to provide corresponding advantages.

The system according to the invention can be operated in fully automatic manner.

Below, the invention including its advantages and with respect to its function is described in greater detail with reference to an embodiment of the system according to the invention, as illustrated in the drawings, wherein.

Figure 1:
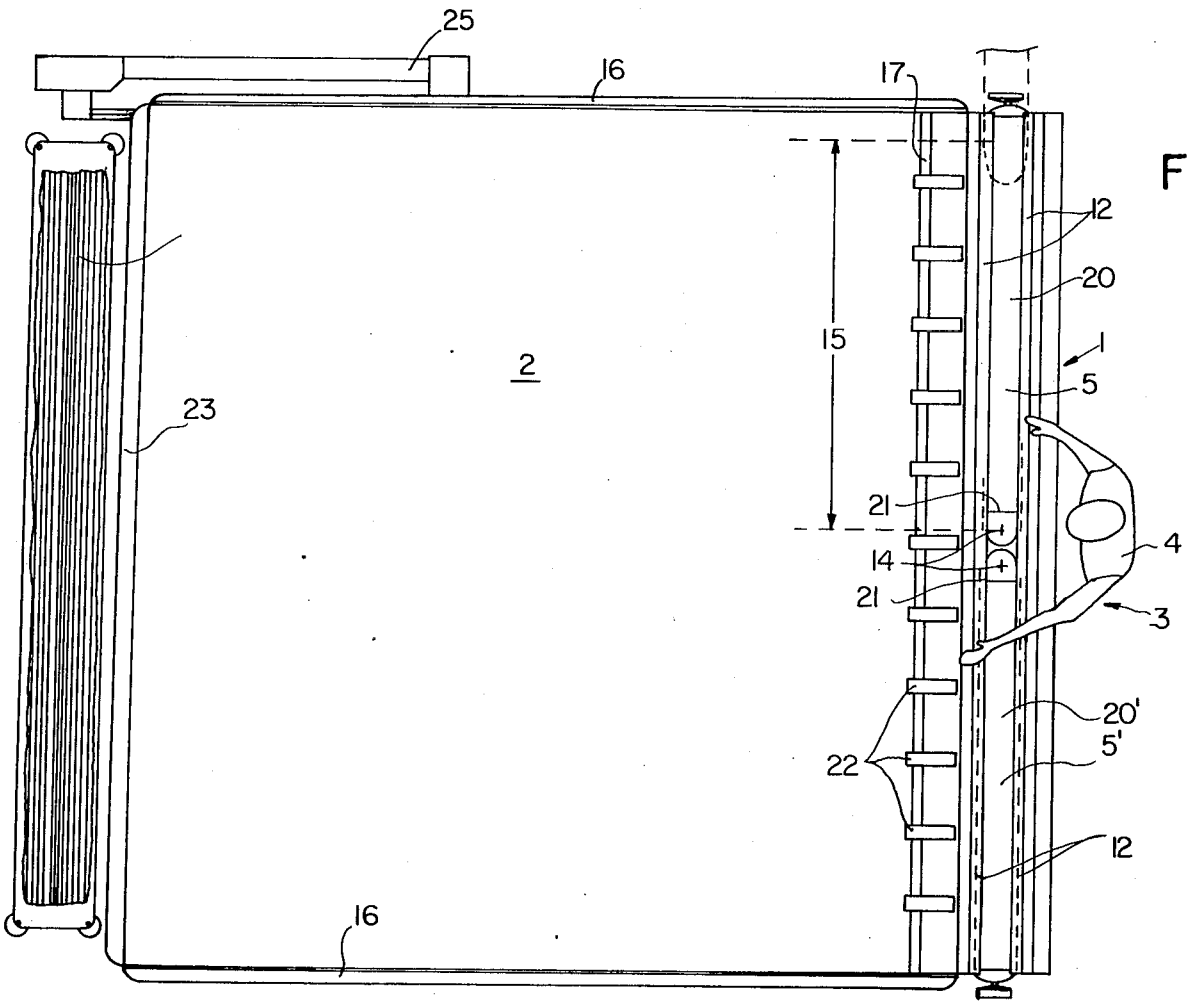
FIG. 1 is a plan view of an automatic quilting system (or apparatus) according to the present invention.
Figure 2:
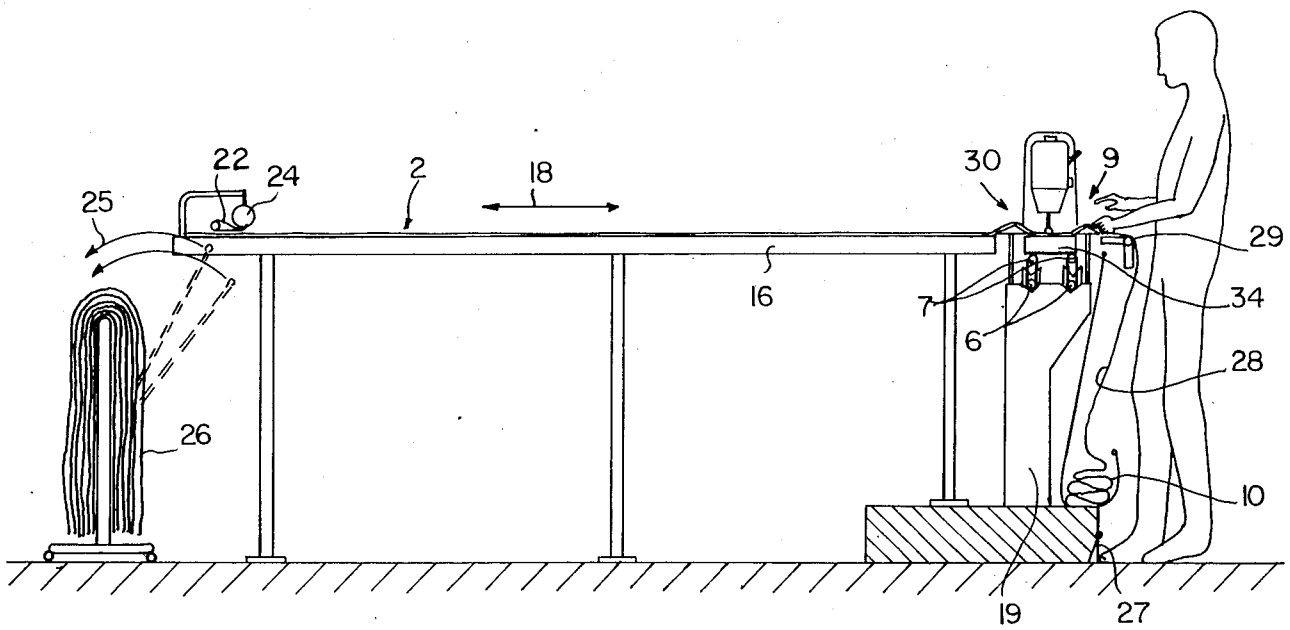
FIG. 2 is a schematical side elevational view of the automatic quilting system according to FIG. 1.

The automatic quilting system (or apparatus) 1 according to FIGS. 1 and 2 includes a work table 2 the length and width dimensions of which are at least as large as the dimensions of the largest workpiece (blank) to be quilted. At the front of the work table 2, there is an operating position 3 for an operator 4. In this operating position 3, there is mounted on a machine frame 19 at least one long-arm quilting machine 5, while a second machine of this type may be provided in the case of a correspondingly large operating width. Each of these quilting machines, 5, 5' is positioned in a transverse support 6 and a longitudinal support 7. Each support 6, 7 is equipped with drive means (not shown). The supports and their associated drive means each cooperate to define an exact mechanical guiding or driving system for the long-arm quilting machine 5, 5' controlled thereby. This driving system provides for respective clearance of motion in longitudinal direction by one strip (line) width X (FIG. 3) and in transverse direction, corresponding to the largest arm stroke or reach of the automatic quilting machine, across a distance Y. In the resulting processed web portion or operating field 8 in the form of a rectangle having the sides X and Y (FIG. 3), the quilting machine 5 is movably guided or driven in positively controlled sequences of motion in accordance with a quilting program programmed (stored) in a control unit (not illustrated).

In the embodiment shown in the Figures, the arm reach or stroke 15 amounts to 140 cm. Thus, the automatic quilting system is adapted to quilt in one pass a quilt having a maximum width dimension of 280 cm, by means of a pair of symmetrically arranged and controlled long-arm quilting machines 5, 5'. Each of these quilting machines 5, 5' is provided with a machine arm 20' spanning the arm reach or stroke 15 and carrying at the free end thereof the sewing head 21. The needle guide is identified by reference numeral 14 in the illustration. Starting and stopping of the quilting process and simultaneously of the programmed control of the whole operating sequence is controlled by the operator 4 through a foot switch 27 or a safety manual switch.

In contrast with the conventional manual quilting processes, the operator's duty is no longer to advance the fabric under the needle, but rather merely to position one narrow side of the sacking or tick under the machine arm 20 and in the catch device of the clamping beam 17. The operator 4 illustrated in FIGS. 1 and 2 is just being engaged with this operation. To this end, the automatic quilting system includes a feeder device 9. The latter comprises the supply trough 10 from which the fabric web 28 to be sewed, i. e. the sacking or tick, is drawn upwards and introduced, through a deflection edge or roll 29, into the operating field 8 of the quilting machine 5, 5' and securely clamped by the clamps 22 of the clamping beam 17 in this procedure. Clamping is effected by means of a pneumatic closing device (not shown) for the clamps 22 of the clamping beam 17. To this effect, the feeder device 9 which during the quilting process keeps the fabric web 28 drawn to be smooth and under tension in the operating field 8, is provided with a vacuum bar 12 on either side of the needle guide behind the deflection edge or roll 29.

Accordingly, the clamping device comprises, in addition to the stretching or clamping beam 17, a pair of vacuum bars 12 which are located on opposite sides adjacent to the lower machine arm 34 of the quilting machines 5, 5' and which have in their upper sides suction ports 35 for the fabric web. The vacuum bars 12 are connected to a not illustrated vacuum reservoir or generator through vacuum lines 36.

The vacuum bars 12 have a flat, triangular cross-section with an apex pointing upwards, with the base surface partially overlapping the lower machine arm 34 and the suction ports being disposed in the upper side face at the side of the arm.

Thus, the suction ports are at least in part provided also above the lower machine arm 34, and they act to positively guide the fabric web down to the machine arm or upwards from the latter, respectively, and to maintain the fabric web under a tension and in a sufficiently stationary state in the sewing position even during sewing at high speed. In this connection, it should be noted that the sacking or tick fabrics to be sewed have a high density.

In a manner being surprising to the expert, it has been found in this conjunction that further guide or drive means in addition to the clamping beam and the suction effected by the vacuum bars 12 may be unnecessary.

Disposed in the longitudinal direction on opposite sides of the work table 2 are guide elements 16 between which the clamping beam 17 is guided for movement in the longitudinal direction 18 or return movement in the opposite direction 18'. A drive mechanism (not shown) moves the clamping beam in accordance with the operation cycles in steps corresponding to one strip width X each. In this way, the fabric web 28 is advanced, strip by strip, by one operating (or processing) field 8 each when the quilting machine 5, 5' has completed quilting of one operating field.

At the discharge end 23 of the table 2 upon opening of the clamps 22 the clamping beam 17 transfers the leading narrow side of the sacking or tick 28 to the feeding or transport roll 24. The latter advances the finished quilted fabric web 28 by a given distance and into the operating area of a stacking device 25. The latter stacks the quilted fabric web 28 in well known manner on, for example, a bundling carriage 26 placed to the proper position. Meanwhile, the clamping beam 17 has been returned to the starting position 30 in the direction 18', whereupon another blank to be quilted is positioned.

Figure 3:
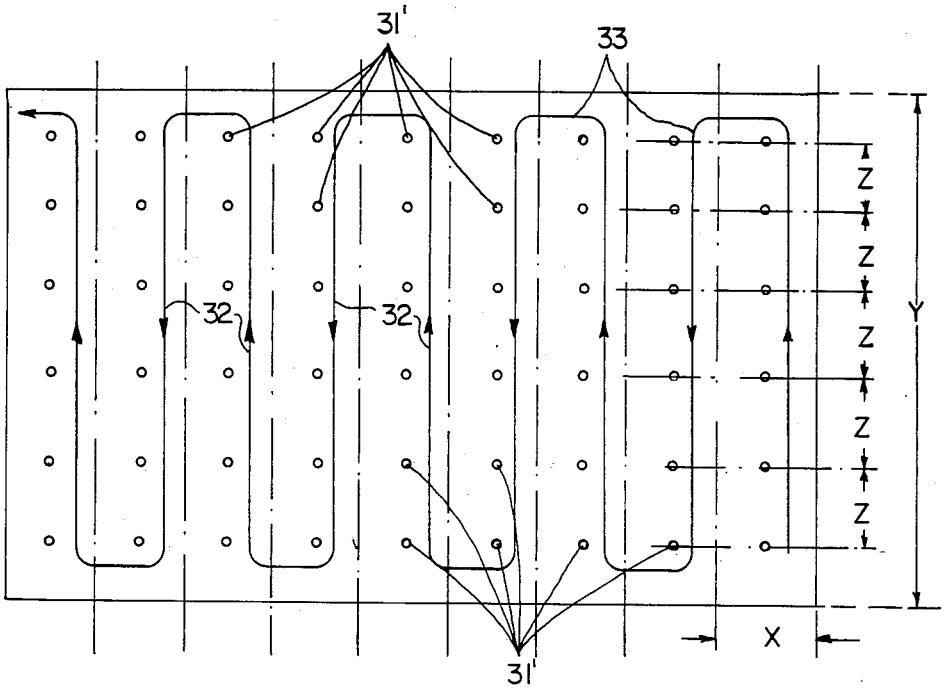
FIG. 3 is a schematic diagram of the operating sequence according to the present method.
Figure 4:
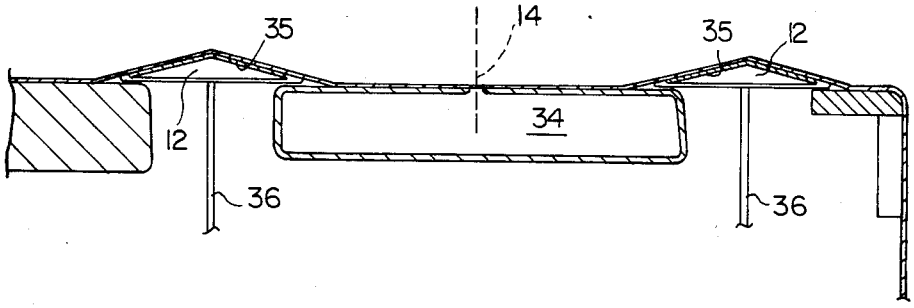
FIG. 4 is a sectional view of the suction and sewing portion of a fabric web.

FIG. 3 shows a diagram of the operation sequence. Starting from the position of the quilting machine 5 as shown in FIG. 1 in which the needle guide 14 positioned, for example, on the left narrow side, as seen from the operator 4, of a sacking or tick 28 occupying only one-half of the table width, the program is started. Then, the quilting machine 5 sews a plurality of points or positions 31 with, for example, regular transverse spacings Z; each of these points 31 constitutes, as is well known in this field of art, a rosette-like annular quilted structure of a size equal to about that of a coin. Forwarded in the direction of arrows 32 in accordance with the program, the automatic quilting machine ultimately reaches the final point 31' in the first operating field 8. Upon reaching this position, the fabric web 28 is further advanced for one strip width X by means of the clamping beam 17, and the next operating field 8' is quilted point by point. Hereby, a relative motion results between the sewing head 21 and the fabric web 28 or sacking (tick) to the quilted along the meandering line 33.

The functioning of the automatic quilting system or of the inherent method according to the invention, respectively, which have been explained in part in the above description of the Figures, may be described briefly as follows:

(1) The quilting machine 5, 5' is in its starting position. The feeder device in the form of the clamping beam 17 is positioned closely below the sewing head 21.

(2) The operator 4 positions the narrow side of the fabric web 28, i.e. sacking or tick, to be sewed under the machine arm 20 and in the clamps 22 of the clamping beam 17; the clamps are closed pneumatically; the vacuum bars 12 are activated by a vacuum; the operator 4 starts the automatic quilting process by means of the switch 27, and the quilting machine 5 starts to operate.

(3) Now, quilting proceeds step 31, 31' by step, and the material is advanced by one line X whenever quilting of one line or strip is completed; the automatic quilting process proceeds along the meandering line 33 until all lines X are quilted; then, the automatic quilting system stops automatically in accordance with a preselected sewing program or after a given number of points 31, 31'.

(4) At the end of the quilting process, clamps 22 are released pneumatically, the clamping beam 17 is restored to the initial position, the front narrow side of the sacking or tick 25 is advanced a distance by the feeding roll 24 and discharged from the stacking device 25 onto the bundling carriage 26.

Subsequently, the sequence of operation is repeated in each cycle.

As indicated above, this operation sequence is controlled centrally and automatically by an electronic control device including a program input unit. Control units of this type are well known in various embodiments in existing automatic quilting machines according to the prior art. In view of the fact that controls of this type constitute prior art of long standing for the equipment of machines controlled with a sequence of operating steps and movements, a more detailed description of such controls in conjunction with the present invention has been omitted.

According to another embodiment of the invention, the automatic quilting machine may be preceded by a cutting machine which automatically cuts upper and/or lower sheets to the desired dimensions and automatically transfers the cut sheets or fabric webs by means of feeding rolls to the input-side clamping beam 17 of the automatic quilting machine.

According to a particularly advantageous embodiment of the invention, it is also possible to continuously sew longitudinal seams by drawing the fabric sheet through under the sewing head with the latter being stationary. This is possible for the reason that, owing to the vacuum bars according to the invention as disposed in the sewing area, satisfactory positioning and fixing of the fabric web even during the longitudinal movement (advance) thereof is ensured such that a linear, faultless quilting seam may be produced. In this instance, longitudinal seams disposed side by side may be produced by separate sewing heads in side-by-side relation, unless the fabric web is returned to the starting position and a new seam adjacent to the first seam is thereafter produced by again drawing the fabric web through the system.

I claim:

1. In a method of automatically producing sewn points in fabric webs by producing the sewn points during, and with the aid of, a freely programmable relative movement between the fabric web and at least one sewing machine head, the improvement comprising:

drawing a fabric web against a constant take-up force along a linear path;

sucking the fabric web against vacuum bars positioned on opposite sides of a processed web portion extending transversely of said path;

performing program-controlled motions by a sewing head in said processed web portion extending transversely of said path.

2. The method improvement according to claim 1, in which the step of performing program-controlled motions comprises quilting by said sewing head the processed web portion of the fabric web as defined by length and width, in one cycle of operation each in accordance with a program and in reciprocating fashion with the fabric web being held stationary, and advancing the fabric web in steps by one web portion after every operating cycle.

3. The method improvement according to claim 2, in which the quilting step comprises quilting by a pair of sewing heads the processed web portion, in a freely programmable fashion, each across a width corresponding to one-half of the width of the fabric web.

* * * * *